United States Patent [19]

Lawrence

[11] Patent Number: 4,911,424

[45] Date of Patent: Mar. 27, 1990

[54] SHEET SORTING MACHINE

[75] Inventor: Frederick J. Lawrence, Tustin, Calif.

[73] Assignee: Gradco Systems, Inc., Irvine, Calif.

[21] Appl. No.: 484,607

[22] Filed: Apr. 13, 1983

[51] Int. Cl.[4] ..... B65H 29/58

[52] U.S. Cl. ..... 271/293; 271/294

[58] Field of Search ..... 271/293, 294

[56] References Cited

U.S. PATENT DOCUMENTS 4,214,746 7/1980 Redding et al. ..... 271/293

4,332,377 6/1982 Du Bois et al. ..... 271/293

FOREIGN PATENT DOCUMENTS 2066778 7/1981 United Kingdom ..... 271/293

2075957 11/1981 United Kingdom ..... 271/293

*Primary Examiner*—Andres Kashnikow

*Assistant Examiner*—Matthew C. Graham

*Attorney, Agent, or Firm*—Newton H. Lee, Jr.

[57] ABSTRACT

A sheet sorting machine of the shifting tray type has a plurality of trays mounted for shifting movement past a sheet infeed location during sorting operation. The trays are pivoted to widely spaced relation at the entry location and are also cammed open by tray ends at distal ends of the trays in response to the pivotal motion. A tray support is moved with the trays to maintain uniform tray angle.

5 Claims, 3 Drawing Sheets

5
M2
M1
21
14
32
23
13
11a
12
22
20
11
19
15
53
30
17
54
10
4
4
14
13
11

SHEET SORTING MACHINE

BACKGROUND OF THE INVENTION

Sorters of the shifting bin type have been developed to conserve space by enabling the bins to be closed when not receiving sheets but open to facilitate entry of sheets.

In my prior patent 4,343,463 there is disclosed a shifting bin sorter which moves the bins, by means of spiral cams, between positions above and below the cams during sorting operations. In my prior patent 4,337,936 a larger number of bins are moved by spiral cams at the inlet to the bins and a screw shaft at the distal ends of the bins to minimize angle of the bin trays. In Du Bois and Hamma 4,397,401, the bins are shifted at their distal ends, to minimize angle by a cam arm raised and lowered beneath the distal ends of the bins.

These sorters in which the outer or distal ends of the trays are vertically moved allow the sorter to have a large number of sheets. The sorter in the Du Bois and Hamma application also opens the distal ends of the bins by means of cam tray ends like those disclosed in patent 4,332,377 and the sheets can be removed endwise from the trays.

SUMMARY OF THE INVENTION

The present invention is an improvement over the sorter of Du Bois and Hamma patent 4,397,401, in that it provides smooth operation and is extremely simple by comparison but retains the advantage of access to the sheets. The present invention employs bin shifting means in accordance with my patent 4,343,463, movement of the outer ends of the bins in unison by an underlying support as in my patent 4,337,936 but with a more simple structure and access to the sorted sets of sheets.

More particularly, the present invention provides a support_structure engageable beneath the lowermost tray and suspended on the uppermost tray, whereby the trays can be successively moved to and from locations above and below the sheet inlet location during sorting operations.

This invention possesses many other advantages and has other purposes which may be made more clearly apparent from a consideration of the forms in which it may be embodied. The preferred form is shown in the drawings accompanying and forming part of the present application. It will now be described in detail, for the purpose of illustrating the general principals of the invention; but it is to be understood that such detailed description is not to be taken in a limiting sense.

DESCRIPTION OF THE PREFERRED EMBODIMENT

Figure 1:
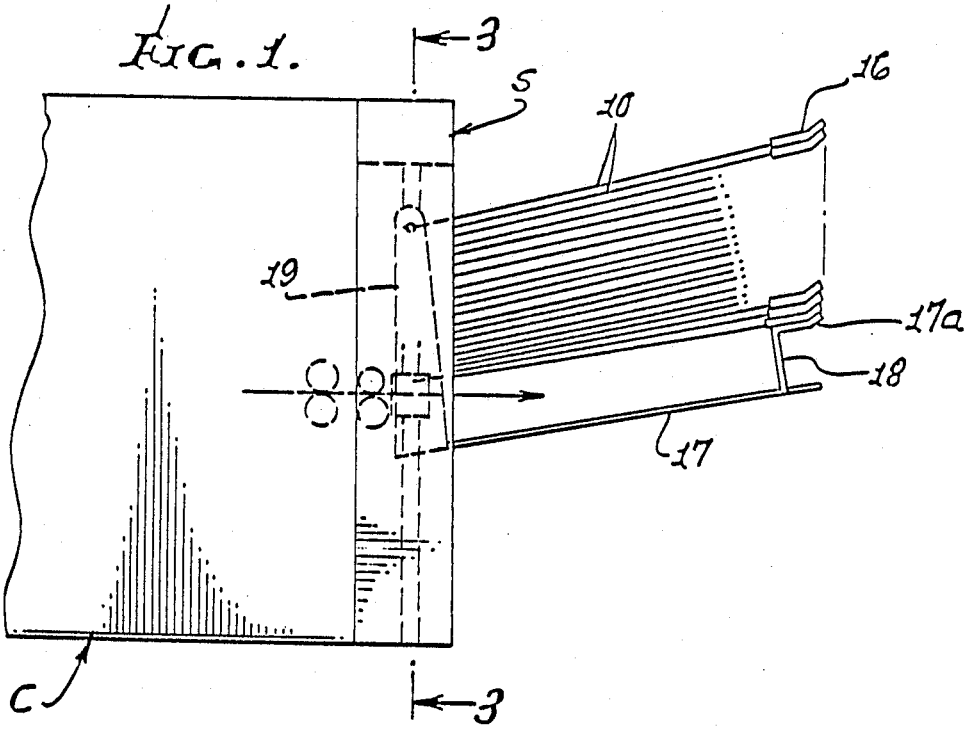
FIG. 1 is a side elevation showing the sorting machine applied to a copier, with the trays in an upper position.
Figure 2:
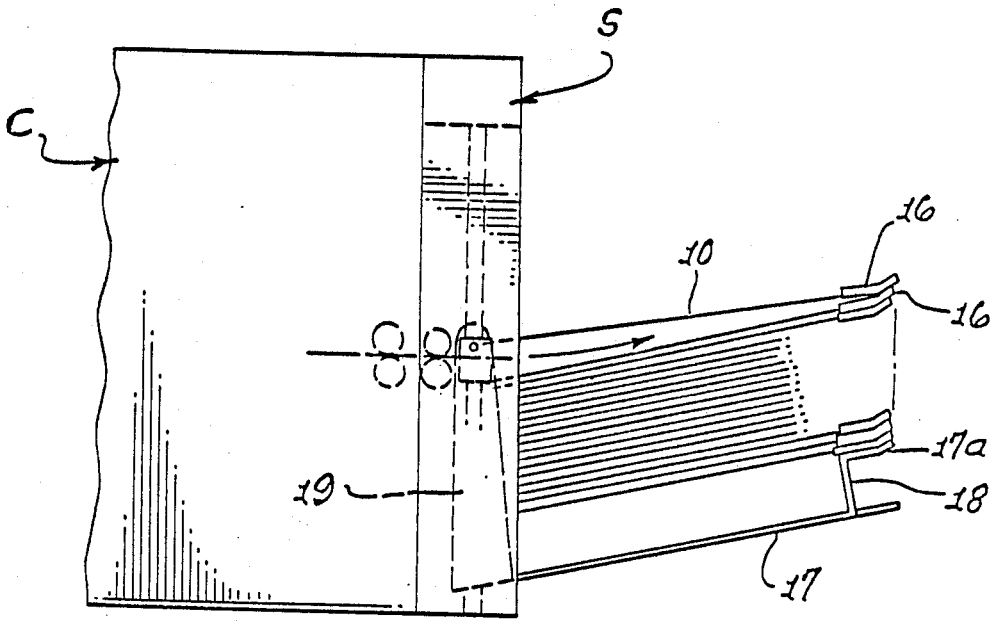
FIG. 2 is a view corresponding with FIG. 1, with the bins in a lower position.
Figure 3:
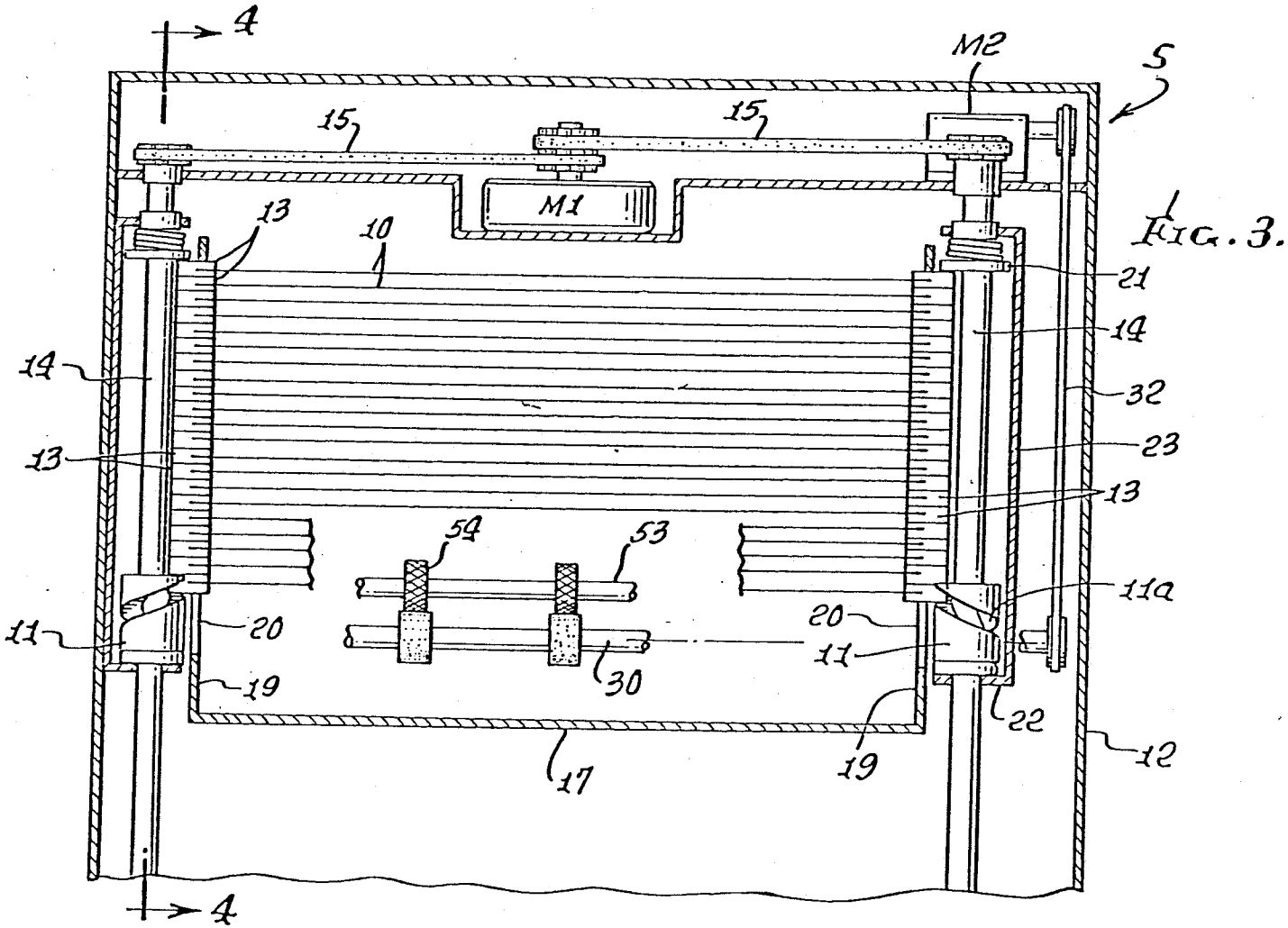
FIG. 3 is a vertical section on the line 3—3 of FIG. 1.
Figure 4:
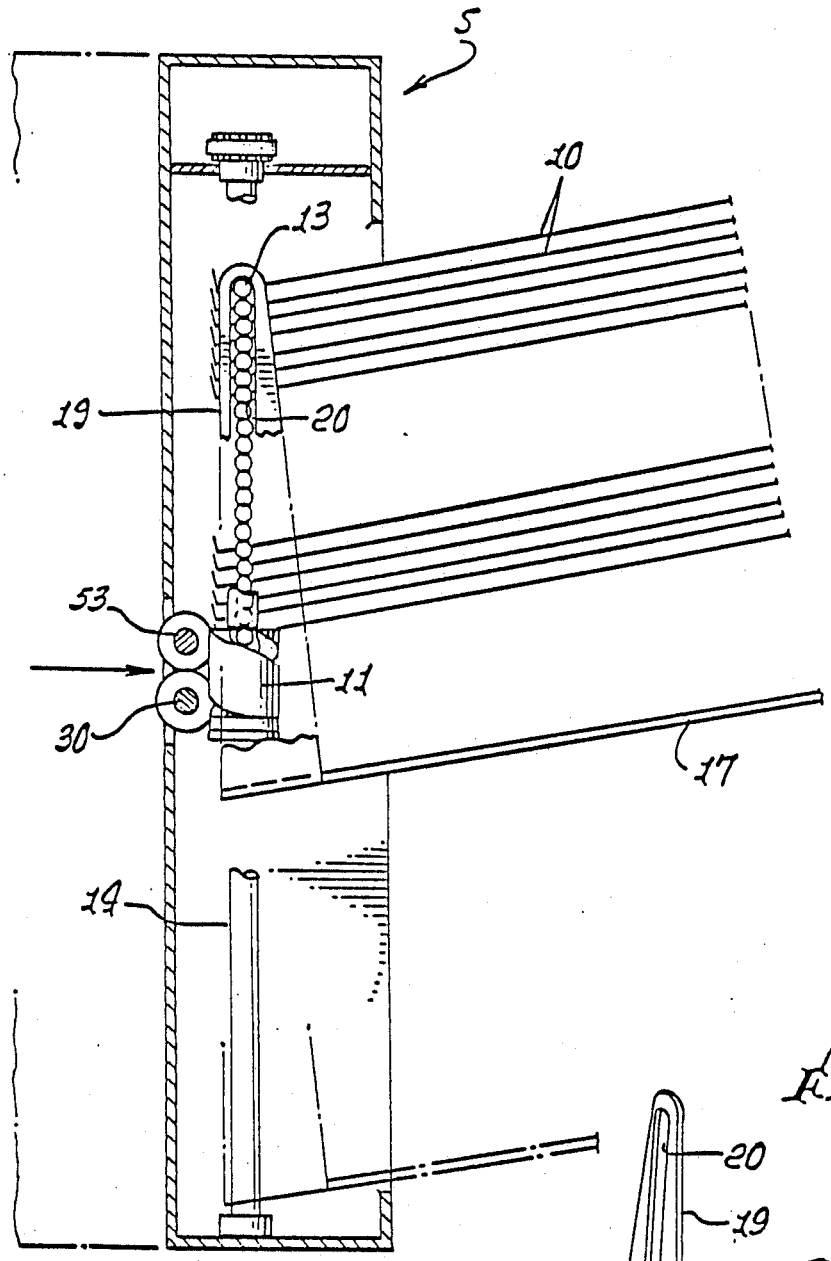
FIG. 4 is a vertical section on the line 4—4 of FIG. 3.
Figure 5:
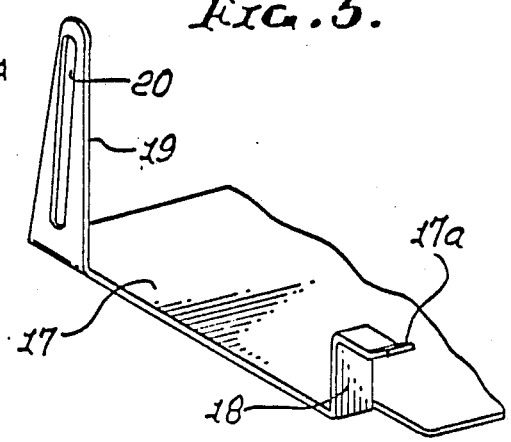
FIG. 5 is a fragmentary detail showing the bin support.

As seen in the drawings, a sheet sorter S in accordance with the invention is adapted to be associated with an office copier of any well known type having a sheet transport T adapted to discharge sheets from the copier, as indicated by the arrows in FIGS. 1 and 2.

The sorter is adapted to sequentially vertically shift a number of trays 10 between positions above the sheet entry location and positions below the sheet entry location, during sheet sorting operations. The bin shifting means, as herein, shown is essentially the same as disclosed in my prior patent (4,343,463). A pair of rotary bin shifting members 11 are disposed at opposite sides of a frame structure 12 and engage trunnions 13 which project laterally from opposite sides of the trays 10 at their inner ends.

As shown, shifters 11 are spiral cams rotatable with shafts 14 at opposite sides of the bins and adapted to be rotated in opposite directions by a reversible electric motor M1 and timing chains or belts 15 to shift the bins sequentially and allow sheet entry into the selected bins. A control system for the motor is shown, for example, in my prior patent 4,343,463, in FIG. 13, incorporated herein by this reference.

It will be understood that as the trays are shifted, the trunnions of adjacent trays will be spaced apart by the cams 11 to provide a wide sheet entry, as seen in FIG. 2. In addition, the outer or distal ends of the trays are supported for pivotal movement on nesting cam tray ends 16, more specifically disclosed in prior patent 4,332,377 to open the outer ends of the trays and facilitate entry of sheets, particularly long sheets which extend beyond the outer ends of the trays.

According to a feature of the present invention, the means for pivotally supporting the outer ends of the trays, by supporting the lowermost tray is adapted to move vertically as the inner ends of the trays move vertically. This is accomplished by providing a receiver tray 17 which has supports 18 at its outer end forming cam tray ends **17*a* for the lowermost tray. The receiver is spaced well below the lowermost tray to receive a large number of sheets when the apparatus is operated in a non-sort mode. The cam tray ends and supports 18** are spaced laterally to enable sheets to pass therebetween.

At its inner end, the receiver tray is supported or suspended from the uppermost tray by a pair of ears 19 at opposite sides of tray 17 having vertically extended slots 20 into which the trunnions extend, with the ears 19 at the top of the slot engaging the uppermost trunnion 13. Since the trunnions seat one on the other and on the shifters 11, the receiver is lowered and raised as the trays are sequentially shifted by the cams 11.

In the illustrative form the trunnions are confined between a spring loaded top stop 21 and a bottom stop 22 in a cage 23 which moves vertically with the trays, as more fully illustrated in my patent 4,343,463. However, since the distance between the stops 21 and 22 equals the height of the cam 11 and 19 of the 20 trunnions shown, one trunnion will at all times be in the cam slot **11*a*** so that a resilient force is not required to load the trunnions into the cam shaft.

In the case of some copying machines, the transport T may suffice to carry the sheets into the bins. However, the sorter shown has an infeed, comprising a driven shaft 30, having resilient feed rolls 31 thereon, driven by a motor M2 and a pulley and belt drive 32. Above the driven shaft 30 is a pinch roll shaft 33 having pinch rolls 34, whereby sheets are positively driven into the bin trays.

From the foregoing, it will now be apparent that the invention provides a sorter apparatus which, by virtue of the fact that the trays move vertically at their inner ends, are cammed apart at their outer ends, due to the pivotal movement, and because the trays are open at the outer ends, can receive a large number of sheets per tray from a fixed sheet inlet, and the sheets can be easily removed.

I claim:

1. Sheet sorting apparatus of the shifting bin type comprising: a frame structure, a plurality of trays in a vertical stack having inner ends in said frame structure and outer ends pivotally and separably supported one above the other on the lowermost tray, trunnions projecting laterally from opposite sides of said inner ends of said trays pivotally and vertically shiftably mounting said inner ends in said frame structure, tray shifting means engageable with said trunnions in said frame structure and operable to successively shift the inner ends of said trays vertically between positions above and below said shifting means and open adjacent trays to receive sheets, drive means to drive said tray shifting means in opposite directions, and means engageable with the upper most tray at its inner ends supporting the lowermost of said trays at the outer ends thereof to move vertically with the inner end of said uppermost tray with said trays inclined towards said outer ends.

2. Sheet sorting apparatus as defined in claim 1, wherein the means supporting the lowermost of said outer ends is connected to the trunnions of the uppermost tray.

3. Sheet sorting apparatus as defined in claim 1, wherein said outer ends of said trays are supported on cam tray ends which separate said outer ends in response to pivotal movement of said trays.

4. Sheet sorting apparatus as defined in claim 1, wherein said tray shifting means comprise spiral cams, a cage having spaced stops at opposite sides of said spiral cams, said trunnions and spiral cams being confined between said stops.

5. Sheet sorting apparatus as defined in claim 1 said tray shifting means including a pair of rotary shafts at opposite sides of said trays, spiral cams on said shafts, drive means for effecting rotation of said spiral cams in opposite directions, a pair of stops at opposite sides of said spiral cams spaced along said shafts an axial distance equal to the axial dimension of said spiral cams plus all of said trunnions except one of said trunnions.

* * * * *